United States Patent [19]

Mode et al.

[11] 4,258,881

[45] Mar. 31, 1981

[54] RIMMED SIMPLEX CARTON WITH TUCKED ENDS AND BLANK FOR FORMING SAME

[75] Inventors: Duane Mode, Minneapolis; Daniel P. Dutcher, Woodbury, both of Minn.

[73] Assignee: Champion International Corporation, Stamford, Conn.

[21] Appl. No.: 91,520

[22] Filed: Nov. 5, 1979

[51] Int. Cl.[3] ..... B65D 5/22

[52] U.S. Cl. ..... 229/34 HW; 229/8; 229/31 FS

[58] Field of Search ..... 229/8, 34 R, 34 HW, 229/31 FS, 32

[56] References Cited

U.S. PATENT DOCUMENTS

| | | | |
|---|---|---|---|
| 1,568,982 | 1/1926 | Lengsfield | 229/8 |
| 2,373,730 | 4/1945 | Williamson et al. | 229/31 FS X |
| 2,597,289 | 5/1952 | Caskey | 229/8 X |
| 2,687,839 | 8/1954 | Gray | 229/34 HW |
| 2,765,113 | 10/1956 | Williamson | 229/34 HW |
| 3,511,429 | 5/1970 | Brian | 229/31 FS |
| 4,042,167 | 8/1977 | D'Alessio | 229/34 HW |

*Primary Examiner*—Davis T. Moorhead

*Attorney, Agent, or Firm*—Evelyn M. Sommer

[57] ABSTRACT

A carton and the blank for forming same each have a plurality of wall members mounted on a base member. Adjacent ends of respective wall members are secured together by the engagement of tabs extending from and hingedly coupled to longitudinal ends of one set of opposed wall members and of cover and tuck flaps hingedly mounted on the remaining wall members. The cover flaps overlie the tabs to entrap them between the one set of wall members and the cover flaps. The tuck flaps are secured in tuck slots in the base member below the one set of wall members to lock the wall members in place. This permits partial assembly of the carton to enable shipping and storing in a flat configuration, and final assembly at the place of filling without the use of glue.

11 Claims, 9 Drawing Figures

76
66
90
86
82
118
88
60
72
114
56
70
86
84
62
104
108
118
112
100
96
92
110
98
112
118
106
90
62
72
116
78
86
50
34
102
94
68
87
48
42
118
80
86
52
58
74
64
32
30
28
54
42
42

118
78
112
108
60
100
74
92
118
58
18
82
80
20
76
112
12
118
94
102
32
110
84
112
118

Fig. 5
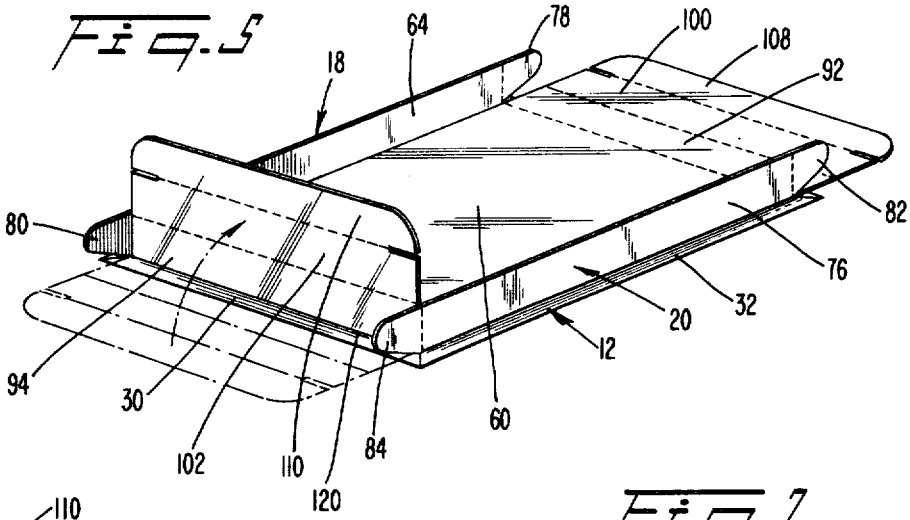
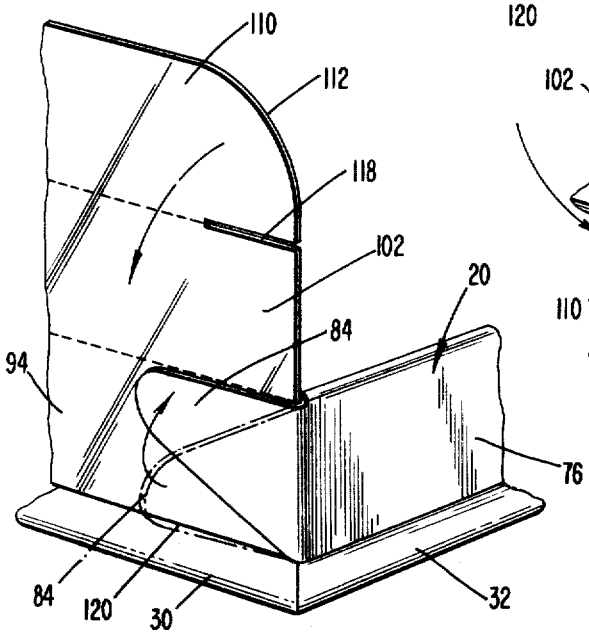
Fig. 6
Fig. 7
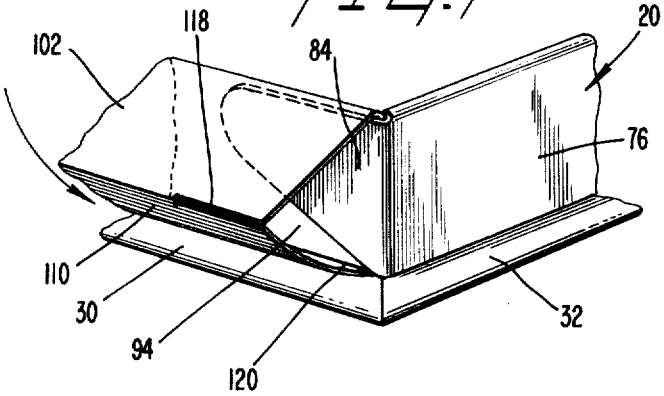
Fig. 9
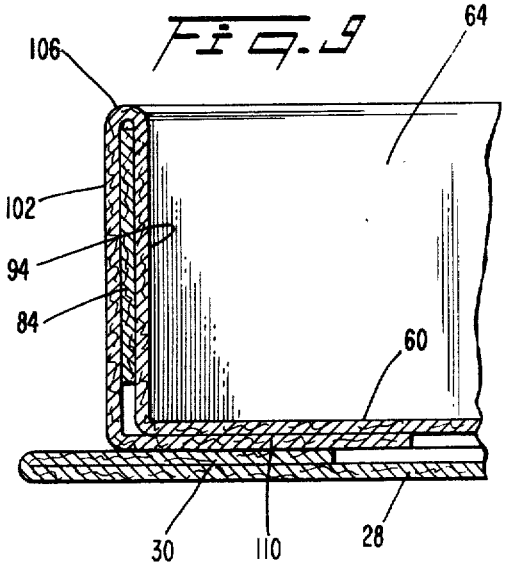
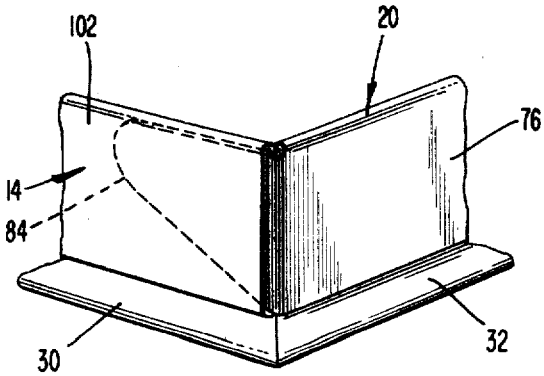
Fig. 8

RIMMED SIMPLEX CARTON WITH TUCKED ENDS AND BLANK FOR FORMING SAME

FIELD OF THE INVENTION

The present invention relates to a carton and a blank for forming the carton. More particularly, the present invention relates to the provision of tabs on one set of wall members and of cover flaps and tuck flaps on the other set of wall members, which tabs, cover flaps and tuck flaps lock the wall members in their fully assembled configuration without the use of glue.

Known and conventional cartons for such contents as candy or other confectionary items, comprise a base member with four wall members extending perpendicularly from one surface thereof and arranged in a generally rectangular configuration. The adjacent ends of adjacent wall members are fixed together in order to maintain the wall members in their upright position. The conventional manner of securing the wall members together is by means of an adhesive.

An example of this construction is disclosed in U.S. Pat. No. 4,042,167 to D'Alessio, which patent is assigned to the same assignee as this application. The D'Alessio patent discloses a carton formed from a unitary blank having a base member formed of two panels and having four wall members hingedly mounted on a surface of the base member. Two of the wall members each have a tab extending from and pivotally coupled to each longitudinal ends thereof. Each of the other two opposed wall members has a cover flap pivotally coupled to an edge of the wall member remote from its base member to overlie the tabs and to entrap the tabs between the cover flap and its wall member in the assembled configuration of the carton. The carton is partially assembled by the manufacturer and shipped in a partially assembled, flat configuration. The filler of the carton then completes the assembly by pivoting the wall members to a position perpendicular to the base member, folding the tabs against the outer surfaces of the wall members, and pivoting the cover flap over the tabs. The cover flaps are secured to the tabs and to respective wall members by an adhesive.

The arrangement of the D'Alessio patent, in requiring a gluing operation for final assembly thereof, is disadvantageous in that the user of the carton must purchase special machinery to perform efficiently the final gluing and folding operation.

SUMMARY OF THE INVENTION

Accordingly, it is an object of the present invention to provide a carton and a blank for forming a carton which will interlock its wall members in their proper folded position without the use of glue.

Another object of the present invention is to provide a unitary, planar blank for forming a carton of rugged construction having means for locking its wall members in their proper position without glue.

A further object of the present invention is to provide a carton and a blank which may be partially assembled and shipped in a flat configuration to facilitate shipping and storage, and easily assembled to a final position without the use of glue.

An additional object of the present invention is to provide a carton and a blank for forming same which may be easily and inexpensively formed for mass production operations.

The foregoing objects are attained by providing a carton comprising a base member, first and second opposed wall members hingedly coupled along fold lines to one surface of the base member, first and second cover flaps hingedly coupled along fold lines to the first and second wall members, respectively, at edges thereof remote from the base member, first and second tuck flaps hingedly coupled along fold lines to the first and second cover flaps, respectively, at edges thereof remote from the first and second wall members, third and fourth opposed wall members hingedly coupled to the one surface of the base member along fold lines, each of the third and fourth wall members having a tab extending outwardly from and hingedly coupled to each longitudinal end thereof along a fold line, the tabs being located adjacent longitudinal ends of the first and second wall members, and tuck slots located in said base member below said first and second wall members configured to receive the tuck flaps.

The foregoing objects are also attained by providing a blank consisting of a unitary piece of paperboard for forming a carton, comprising a bottom portion having a lower panel, and an upper portion hingedly attached to the bottom portion along a fold line and including an upper panel, first and second wall panels hingedly attached to the upper panel at opposite edges thereof along fold lines, first and second cover flaps hingedly attached to the first and second wall panels, respectively, at edges thereof remote from the upper panel along fold lines, first and second tuck flaps hingedly attached to the first and second cover flaps, respectively, at edges thereof remote from the first and second wall panels, respectively, along fold lines, first and second wall member forming means hingedly attached to the upper panel at remaining opposite edges thereof along fold lines, and tabs hingedly attached to longtudinal ends of the first and second wall forming means along fold lines.

By forming the carton and blank of the present invention in this manner, the wall members may be secured in their proper position by locking them to each other without the use of glue. Thus, the partially assembled carton may be easily and economically shipped and stored in a flat configuration and then be easily assembled by unskilled personnel manually without gluing. This eliminates the necessity of expending large sums of capital for automatic gluing and folding machinery.

Other objects, advantages and salient features of the present invention will become apparent from the following detailed description, which taken in conjunction with the annexed drawings, discloses a preferred embodiment of the present invention.

BRIEF DESCRIPTION OF THE DRAWINGS

Referring to the drawings which form part of this original disclosure:

FIG. 5 is a perspective view of the carton of FIG. 1 as it is undergoing final assembly;

FIGS. 6–8 are partial perspective views illustrating various steps performed during final assembly of the carton of FIG. 1; and FIG. 9 is a partial side view in cross section of the joint between the wall members of the carton of FIG. 1.

DETAILED DESCRIPTION OF THE PREFERRED EMBODIMENT OF THE INVENTION

Figure 1:
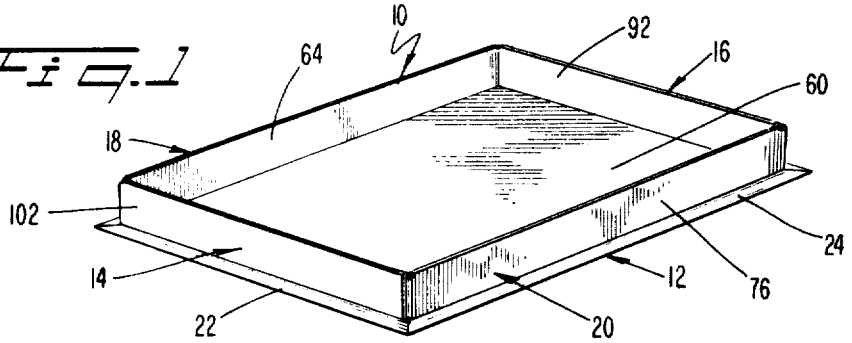
FIG. 1 is a perspective view illustrating a carton in its fully assembled configuration in accordance with the present invention.

Referring to FIG. 1, the completely assembled carton 10 includes a rectangular base member 12 and four upstanding wall members 14, 16, 18, 20 of rectangular configuration mounted on the base member 12. The wall members 14, 16, 18, 20 extend generally perpendicular to the plane of the base member 12.

The first wall member 14 is disposed opposite the second wall member 16 and together they comprise the end walls of the carton 10. The third wall member 18 is disposed opposite the fourth wall member 20 and together they comprise the side walls of the carton 10. The four wall members are arranged in the configuration of a rectangle and are each spaced from the peripheral edge 22 of the base member 12 to provide a peripheral flange 24 which surrounds the wall members 14, 16, 18, 20. The adjacent ends of the wall members 14, 16, 18, 20 are coupled together, in a manner to be discussed in detail hereinafter, to maintain each of the wall members 14, 16, 18, 20 in its proper upright position.

Figure 2:
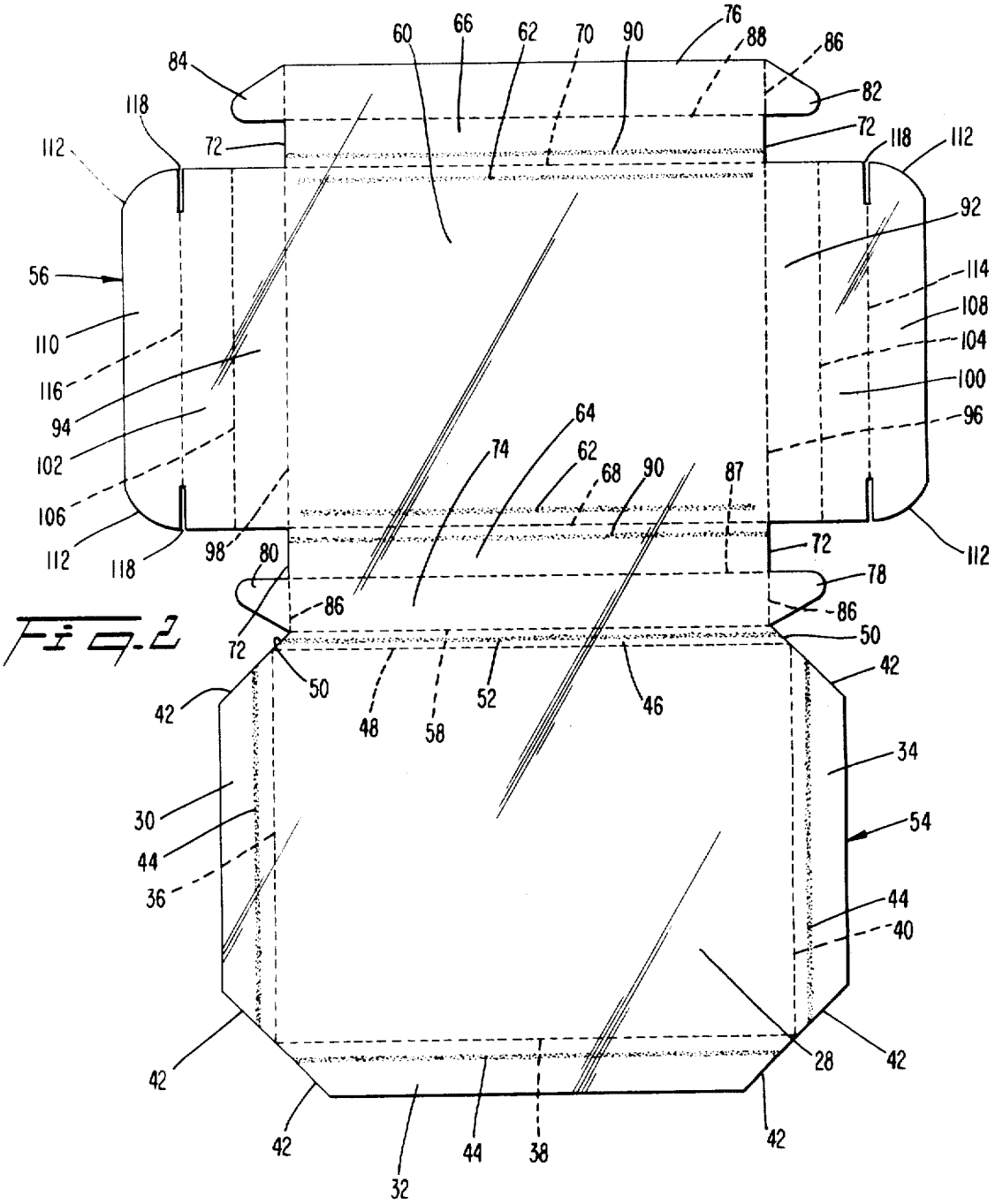
FIG. 2 is a plan view illustrating a blank for forming the carton of FIG. 1.

Referring now to FIG. 2, the blank 26 for forming the carton 10 comprises a single piece of paper stock, e.g., paperboard.

The blank 26 includes a generally rectangular lower panel 28. First, second, and third flaps 30, 32, 34 are attached to and extend from two end edges and one side edge of the lower panel 28. Embossed fold lines 36, 38, 40 extend along the entire length of the junctures between the flaps 30, 32, 34, respectively, and the lower panel 28 to hingedly or pivotally couple each of these flaps to the bottom panel 28. The longitudinal ends 42 of each of the flaps 30, 32, 34 are mitered to form the flaps 30, 32, 34 in the general shape of a trapezoid. Mitering of the ends 42 enables the ends to abut when the flaps 30, 32, 34 are folded about the fold lines 36, 38, 40 to overlie the lower panel 28. Adhesive strips 44 are provided on the inner surfaces of the flaps 30, 32, 34 so that the flaps 30, 32, 34 will be adhered to the lower panel 28.

A fourth flap 46 is attached to the remaining edge of the lower panel 28. An embossed fold line 48 extends along the entire length of the juncture between the fourth flap 46 and the lower panel 28 to hingedly couple them. Similar to the flaps 30, 32, 34, the flap 46 has mitered longitudinal ends 50 so that the adjacent ends 42 of the flaps 30, 34 abut ends 50 when the flap 46 is folded about line 48. An adhesive strip 52 is provided on the inner surface of the flap 46 to adhere the flap 46 to the lower panel 28.

The blank 26 comprises a bottom portion 54 and an upper portion 56. The terms "bottom" and "upper" refer to the orientations of these portions of the blank 26 in the assembled configuration of the carton 10 illustrated in FIG. 1. The bottom portion 54 comprises a lower panel 28, and the flaps 30, 32, 34, 46. The upper portion 56 is attached to and extends from the fourth flap 46, and is hingedly coupled thereto by a scored fold line 58 which extends across the entire length of the juncture between the fourth flap 46 and the upper portion 56.

The upper portion 56 has an upper panel 60 located in its center. The upper panel 60 is of generally rectangular configuration and has adhesive strips 62 extending parallel to and adjacent the longitudinal side edges of the upper panel 60. The adhesive strips 62 are located on the surface of the panel 60 which will contact the bottom portion 54 of the blank 26 in the folded configuration of the carton 10. The upper panel 60 has length and width dimensions that are somewhat less than those of the lower panel 28.

Attached to the longitudinal side edges of the upper panel 60 are generally rectangular, inner side wall panels 64, 66. Scored fold lines 68, 70 extend along the entire length of the junctures between the upper panel 60 and the inner side wall panels 64, 66, respectively, to provide hinged couplings therebetween. The longitudinal ends 72 of the panel 64, 66 are oriented perpendicular to the fold lines 68, 70.

Generally rectangular, outer side wall panels 74, 76 are attached to the inner side wall panels 64, 66, respectively, along the side edges thereof remote from the upper panel 60. Embossed fold lines 87,88 extend along the entire length of the junctures of the panels 64, 66 and the panels 74, 76 respectively, to provide hinged couplings therebetween. The outer side wall panel 74 abuts and is hingedly joined to the fourth flap 46 along the fold line 58. Tabs 78, 80 are attached to opposite longitudinal ends of the outer side wall panel 74, while tabs 82, 84 are attached to the longitudinal ends of the outer side wall panel 76. Fold lines 86 extend along the entire length of the junctures of the tabs 78, 80, 82, 84 and their respective outer side wall panels 74, 76 to provide hinged couplings therebetween.

Adhesive strips 90 are provided on the surfaces of the panels 64, 66 which will abut surfaces of the panels 74, 76, respectively, to adhere such panels together in the folded configuration of the carton 10. The length and width dimensions of the panels 64, 66, 74, 76 are substantially equal.

First and second end wall panels 92, 94, are attached to the longitudinal ends of the upper panel 60. The panels 92, 94 are generally rectangular in shape. Scored fold lines 96, 98 extend along the entire length of the junctures between the upper panel 60 and the end wall panels 92, 94, respectively, to provide hinged couplings therebetween.

It should be noted that no adhesive strips, similar to strips 62, are provided on the surface of the upper panels 60 adjacent the fold lines 96, 98. The purpose of this will be explained in detail hereinafter.

Cover flaps 100, 102 are attached to the longitudinal side edges of the end wall panels 92, 94, respectively. The cover flaps 100, 102 are generally rectangular in configuration and are generally of the same dimensions as the end wall panels 92, 94. Embossed fold lines 104, 106 extend along the entire length of the junctures between the cover flaps 100, 102 and the end wall panels 92, 94, respectively, to provide hinged couplings therebetween.

Tuck flaps 108, 110 are attached to the cover flaps 100, 102, respectively, along the longitudinal side edges thereof remote from the end wall panels 92, 94, respectively. The tuck flaps 108, 110 are generally rectangular in configuration and are generally of the same dimensions as the cover flaps 100, 102, but have longitudinal ends 112 which are rounded. Embossed fold lines 114, 116 extend along the entire length of the junctures of the tuck flaps 108, 110 and the cover flaps 100, 102, respectively, to form hinged couplings therebetween. Narrow slits 118 extend inwardly for a short distance from the longitudinal ends of the tuck flaps 108, 110 adjacent the fold lines 114, 116.

Figure 3:
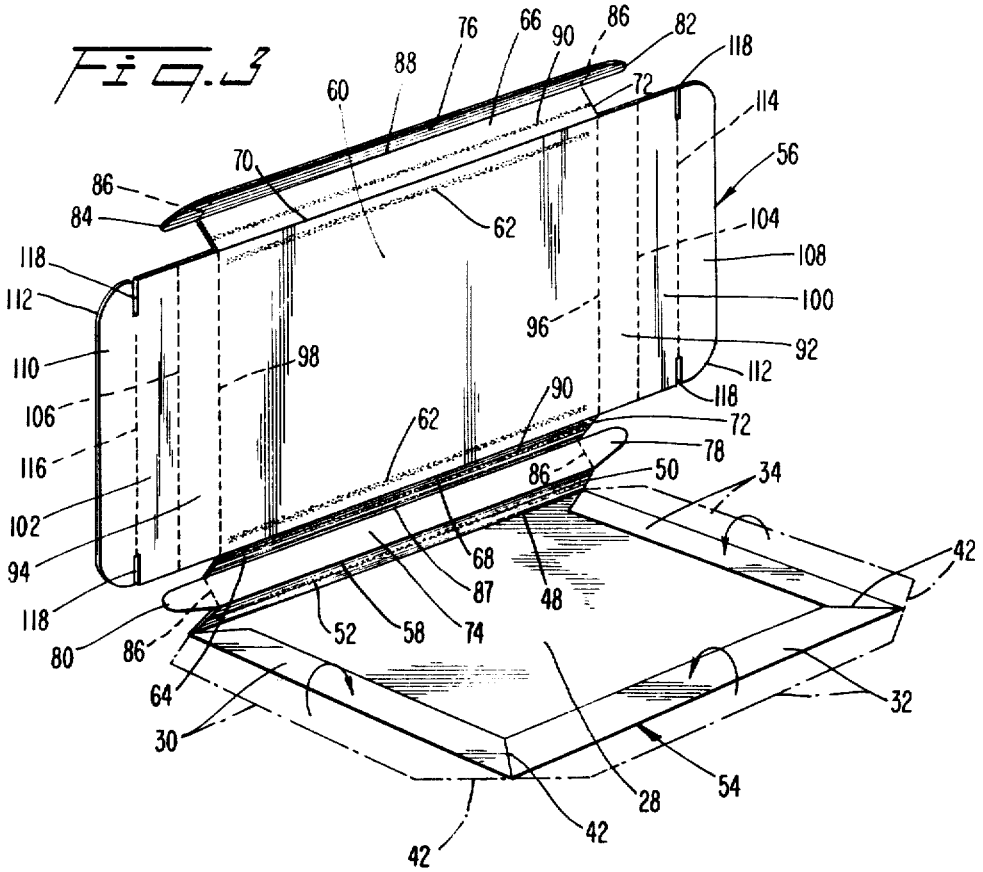
FIG. 3 is a perspective view illustrating the carton of FIG. 1 in a partially folded configuration.

FIG. 3 illustrates the initial assembly of the carton 10 by the folding and gluing of the blank 26. The first, second, third and fourth flaps 30, 32, 34, 46 are folded about fold lines 36, 38, 40, 48, respectively, to lie against the lower panel 28 and be adhered thereto by adhesive strips 44, 52. The inner side wall panels 64, 66 and the outer side wall panels 74, 76 are folded relative to each other, respectively, about fold lines 87, 88 to overlie each other and be adhered together by the adhesive strips 90. The upper portion 56 of the blank 26 is folded relative to the bottom portion 54 about fold line 58 to a position in which the upper panel 60 overlies the bottom panel 28 with the peripheral edge (i.e., fold lines 68, 70, 96, 98) of the upper panel 60 spaced inwardly from the peripheral edge 22 (i.e., fold lines 36, 38, 40, 46) of lower panel 28 to form the peripheral flange 24 of the carton 10. Adhesion of the lower panel 28 to the upper panel 60 is accomplished by the adhesive strips 62. Thereafter, the third and fourth side wall members 18, 20 (formed by the combinations of panels 64, 74 and panels 66, 76, respectively) are folded about fold lines 58, 70 so that the wall members 18, 20 lie against the upper panel 60.

Figure 4:
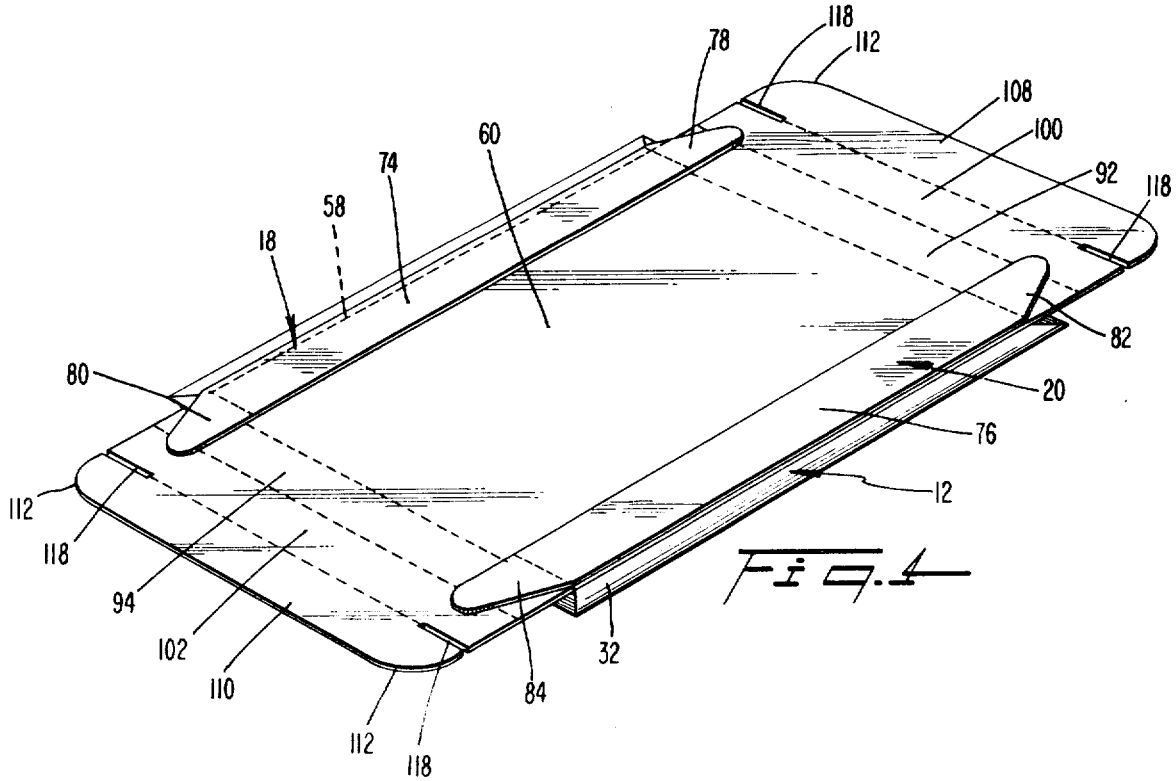
FIG. 4 is a perspective view illustrating the carton of FIG. 1 in its partially assembled configuration for shipping and storing.

In this position, illustrated in FIG. 4, the end wall panels 92, 94, the cover flaps 100, 102, and the tuck flaps 108, 110 remain coplanar with the upper panel 60. It is in this flat configuration that the carton may be easily and efficiently stored and transported.

Once the carton 10, in the configuration illustrated in FIG. 4, has arrived at the manufacturing site of the items to be stored within the carton 10, final assembly of the carton 10 may be accomplished simply without the use of glue. The final assembly steps for the carton are illustrated in FIGS. 5–8.

Since no adhesive strip is provided adjacent the fold lines 96, 98, tuck slots 120 are formed between the lower panel 28 and the upper panel 60 for receiving the tuck flaps 108, 110.

Initially, the side wall panels 18, 20 are folded about fold lines 58, 70 until the side wall members 18, 20 are oriented perpendicular to the base member 12 (comprised of lower panel 28, flaps 30, 32, 34, 46 and upper panel 60). The end wall panels 92, 94 are then folded on lines 96, 98, respectively, to a position in which they are likewise oriented perpendicular to the base member 12. Once the end wall panels 92, 94 are in position, the tabs 78, 82 are folded about lines 86 against the outer face of the end wall panel 92 while the tabs 80, 84 are folded about lines 86 against the outer face of the end wall panel 94, in the manner illustrated for tab 84 in FIG. 6. Thereafter, the cover flaps 100, 102 are folded about the fold lines 104, 106, respectively, and the tuck flaps 108, 110 are folded about the fold lines 114, 116, respectively, in the manner illustrated in FIG. 7, to cause the cover flaps 100, 102 to overlie their respective tabs 78, 80, 82, 84 and to insert the tuck flaps 108, 110 within the tuck slots 120 until the orientation illustrated in FIGS. 8 and 9 is achieved. The combination of the end wall panel 92 and the cover flap 100 forms the second wall member 16, while the combination of the end wall panel 94 and the cover flap 102 forms the first wall member 14.

By this arrangement, the tabs 78, 82 are entrapped between the end wall panel 92 and the cover flap 100, while the tabs 80, 84 are entrapped between the end wall panel 94 and the cover flap 102. This entrapment of the tabs 78, 80, 82, 84 couples the adjacent ends of the wall members 14, 16, 18, 20 to retain such wall members in their perpendicular orientation with respect to the base member 12. The cover flaps 100, 102 are retained in the position illustrated in FIGS. 1, 8 and 9 by the engagement of the tuck flaps 108, 110 by the tuck slots 120. In this manner, there is no need to apply glue to the cover flaps 100, 102 in order to secure them in place as required by the prior art (e.g., the D'Alessio patent discussed above).

Once the carton has been folded to its fully assembled configuration as discussed above it may now be filled with the desired contents. The cover for this container may be formed identially to the carton 10 with the wall members of such cover telescoping over the wall members 14, 16, 18, 20 of the carton 10.

While a particular embodiment has been chosen to illustrate the invention, it will be understood by those skilled in this art that various changes and modifications can be made therein without departing from the scope of the invention as defined in the appended claims.

What is claimed is:

1. A carton comprising a base member;

first and second opposed wall members hingedly coupled along fold lines to one surface of said base member;

first and second cover flaps hingedly coupled along fold lines to said first and second wall members, respectively, at edges thereof remote from said base member;

first and second tuck flaps hingedly coupled along fold lines to said first and second cover flaps, respectively, at edges thereof remote from said first and second wall members;

third and fourth opposed wall members hingedly coupled to said one surface of said base member along fold lines, each of said third and fourth wall members having a tab extending outwardly from and hingedly coupled to each longitudinal end thereof along a fold line, said tabs being located adjacent longitudinal ends of said first and second wall members; and tuck slots located in said based member below said first and second wall members configured to receive said tuck flaps.

2. A carton according to claim 1, wherein said base member, wall members, cover flaps, tuck flaps and tabs are formed from a unitary piece of paperboard.

3. A carton according to claim 1, wherein said wall members are hingedly coupled to said base member along fold lines spaced from peripheral edges of said base member.

4. A carton according to claim 1, wherein said first and second wall members are oriented perpendicular to said third and fourth wall members, and said wall members define a rectangle.

5. A carton according to claim 1, wherein said base member comprises upper and lower panels which are parallel, fixed together and define said tuck slots therebetween.

6. A carton comprising a generally planar base member;

first and second opposed wall members coupled to said base member and oriented generally perpendicular thereto;

first and second cover flaps hingedly coupled along fold lines to said first and second wall members, respectively, at edges thereof remote from said base member;

first and second tuck flaps hingedly coupled along fold lines to said first and second cover flaps, respectively, at edges thereof remote from said first and second wall members; third and fourth opposed wall members coupled to said base member and oriented generally perpendicular to said base member and said first and second wall members, each of said third and fourth wall members having a tab extending generally perpendicularly from each longitudinal end thereof so that said tabs overlie outer surfaces of said first and second wall members, said cover flaps overlying said tabs to entrap said tabs between said first and second wall members and said cover flaps; and tuck slots located in said base member below said first and second wall members, said tuck flaps being located in said tuck slots to secure said wall members in position.

7. A carton according to claim 6, wherein said base member, wall members, cover flaps, tuck flaps and tabs are formed from a unitary piece of paperboard.

8. A carton according to claim 6, wherein said base member comprises upper and lower panels which are parallel, fixed together and define said tuck slots therebetween.

9. A blank consisting of a unitary piece of paperboard for forming a carton, comprising a bottom portion having a lower panel; and an upper portion hingedly attached to said bottom portion along a fold line and including an upper panel, first and second wall panels hingedly attached to said upper panel at opposite edges thereof along fold lines, first and second cover flaps hingedly attached to said first and second wall panels, respectively, at edges thereof remote from said upper panel along fold lines, first and second tuck flaps hingedly attached to said first and second cover flaps, respectively, at edges thereof remote from said first and second wall panels, respectively, along fold lines, first and second wall member forming means hingedly attached to said upper panel at remaining opposite edges thereof along fold lines, and tabs hingedly attached to longitudinal ends of said first and second wall forming means along fold lines.

10. A blank according to claim 9, wherein each of said first and second wall forming means comprises an inner wall panel hingedly attached to said upper panel along a fold line and an outer panel hingedly attached to its inner wall panel at an edge thereof remote from said upper panel along a fold line.

11. A blank according to claim 10, wherein said tabs are hingedly attached to longitudinal ends of said outer wall panels along fold lines.

* * * * *